US010466025B2

(12) United States Patent
Venter et al.

(10) Patent No.: US 10,466,025 B2
(45) Date of Patent: Nov. 5, 2019

(54) WIRELESS DETONATOR

(71) Applicant: DETNET SOUTH AFRICA (PTY) LTD, Johannesburg (ZA)

(72) Inventors: Francois Venter, Johannesburg (ZA); Elmar Lennox Muller, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 37 days.

(21) Appl. No.: 15/774,895

(22) PCT Filed: Aug. 4, 2016

(86) PCT No.: PCT/ZA2016/050028

§ 371 (c)(1),
(2) Date: May 9, 2018

(87) PCT Pub. No.: WO2017/083885

PCT Pub. Date: May 18, 2017

(65) Prior Publication Data

US 2018/0328702 A1 Nov. 15, 2018

(30) Foreign Application Priority Data

Nov. 9, 2015 (ZA) ..... 15/08238

(51) Int. Cl.
*F42D 1/05* (2006.01)
*F42C 11/00* (2006.01)
(Continued)

(52) U.S. Cl.
CPC ..... *F42D 1/05* (2013.01); *F42B 3/121* (2013.01); *F42C 11/00* (2013.01); *F42C 11/06* (2013.01); *F42C 13/04* (2013.01)

(58) Field of Classification Search
CPC .. F42D 1/05; F42B 3/121; F42C 11/06; F42C 13/04
(Continued)

(56) References Cited

U.S. PATENT DOCUMENTS 4,451,867 A * 5/1984 Robertson ..... F42D 1/05 361/248
4,622,558 A * 11/1986 Corum ..... H01Q 1/36 343/742
(Continued)

FOREIGN PATENT DOCUMENTS

EP 0458178 11/1991
WO 0159401 8/2001
(Continued)

OTHER PUBLICATIONS

International Search Report and Written Opinion for Application No. PCT/ZA2016/050028 dated Apr. 11, 2017, 9 pages.

*Primary Examiner* — Joshua E Freeman
*Assistant Examiner* — Bridget A Cochran
(74) *Attorney, Agent, or Firm* — Michael Best & Friedrich LLP

(57) ABSTRACT

A wireless detonator which includes a control unit, an ignition element, an energy source which is configured to fire the ignition element in response to a signal from the control unit, a communication module, and an energy harvesting unit which harvests energy from an external electromagnetic field which is used to power, at least, the communication module.

6 Claims, 1 Drawing Sheet

(51) Int. Cl.
*F42B 3/12* (2006.01)
*F42C 11/06* (2006.01)
*F42C 13/04* (2006.01)

(58) Field of Classification Search
USPC ..... 102/206
See application file for complete search history.

(56) References Cited

U.S. PATENT DOCUMENTS 4,685,396 A * 8/1987 Birse ..... F42D 1/055 102/200
4,762,067 A * 8/1988 Barker ..... E21B 43/1185 102/202.14
4,768,127 A * 8/1988 Desrochers ..... F42D 1/05 102/218
4,777,880 A * 10/1988 Beattie ..... F42D 1/05 102/312
4,819,560 A * 4/1989 Patz ..... F42B 3/13 102/200
4,860,653 A * 8/1989 Abouav ..... F42B 3/122 102/200
4,870,902 A * 10/1989 Simon ..... F42B 3/113 102/201
4,870,903 A * 10/1989 Carel ..... F42B 3/113 102/201
4,884,506 A * 12/1989 Guerreri ..... F42C 11/06 102/200
4,984,518 A * 1/1991 Yarrington ..... F42B 3/113 102/201
5,014,620 A * 5/1991 Leupacher ..... F42B 3/113 102/201
5,027,709 A * 7/1991 Slagle ..... F42B 8/28 102/293
5,038,682 A * 8/1991 Marsden ..... F42C 13/047 102/217
5,101,727 A * 4/1992 Yarrington ..... F42B 3/113 102/201
5,105,742 A * 4/1992 Sumner ..... E21B 43/1185 102/265
5,125,104 A * 6/1992 Ohkawa ..... G01S 5/04 102/209
5,146,044 A * 9/1992 Kurokawa ..... F41A 19/63 102/200
5,148,748 A * 9/1992 Yarrington ..... F42B 3/113 102/201
5,159,149 A * 10/1992 Marsden ..... F42B 3/122 102/207
5,404,820 A * 4/1995 Hendrix ..... F42B 3/113 102/201
5,442,369 A * 8/1995 Van Voorhies ..... H01Q 1/36 343/742
5,654,723 A * 8/1997 Craven ..... H01Q 1/36 343/742
5,756,926 A * 5/1998 Bonbrake ..... F42D 1/05 102/206
5,933,263 A * 8/1999 Kinstler ..... H04B 10/807 102/207
6,079,333 A * 6/2000 Manning ..... F42D 1/05 102/200
6,199,483 B1 * 3/2001 Barbiche ..... F42B 3/113 102/201
6,253,679 B1 * 7/2001 Woodall ..... F42C 13/047 102/206
6,374,740 B1 * 4/2002 Moulard ..... C06C 7/00 102/201
6,386,108 B1 * 5/2002 Brooks ..... E21B 43/1185 102/217
6,422,145 B1 * 7/2002 Gavrilovic ..... F42D 1/05 102/200
6,450,817 B1 * 9/2002 Deinlein ..... F41G 3/26 434/11
6,470,803 B1 * 10/2002 Liu ..... F42D 1/05 102/206
6,557,636 B2 * 5/2003 Cernocky ..... E21B 43/1185 166/297
6,584,907 B2 * 7/2003 Boucher ..... B60R 21/017 102/202.5
6,595,137 B1 * 7/2003 Karlsson ..... F42C 15/40 102/206
6,644,202 B1 * 11/2003 Duniam ..... F42D 1/055 102/215
6,752,083 B1 * 6/2004 Lerche ..... E21B 43/1185 102/202.5
6,860,206 B1 * 3/2005 Rudakevych ..... F42C 15/42 102/206
6,945,174 B2 * 9/2005 Aebi ..... F42D 1/055 102/200
7,130,624 B1 * 10/2006 Jackson ..... F41H 13/0075 455/420
7,347,278 B2 * 3/2008 Lerche ..... E21B 41/00 102/215
8,070,057 B2 * 12/2011 Jain ..... G06K 7/10237 235/380
8,688,244 B2 * 4/2014 Kalhoff ..... G05B 19/4183 340/12.51
9,581,422 B2 * 2/2017 Preiss ..... F42C 19/12
2002/0178955 A1 * 12/2002 Gavrilovic ..... F42D 1/05 102/200
2003/0000411 A1 * 1/2003 Cernocky ..... E21B 43/1185 102/200
2003/0001753 A1 * 1/2003 Cernocky ..... E21B 43/1185 340/853.1
2003/0029344 A1 * 2/2003 Eddy ..... F42B 3/121 102/200
2003/0116048 A1 * 6/2003 Bossarte ..... F41A 19/58 102/202.5
2004/0031411 A1 * 2/2004 Novotney ..... F42B 3/113 102/200
2004/0225431 A1 * 11/2004 Aebi ..... F42D 1/05 701/110
2005/0011389 A1 * 1/2005 Teowee ..... F42D 1/05 102/200
2005/0015473 A1 * 1/2005 Teowee ..... F42D 1/05 709/223
2006/0207461 A1 * 9/2006 Koekemoer ..... F42C 15/40 102/206
2007/0044673 A1 * 3/2007 Hummel ..... F42B 3/113 102/206
2008/0307993 A1 * 12/2008 Chan ..... F42B 3/113 102/214
2009/0193993 A1 * 8/2009 Hummel ..... F42D 1/055 102/215
2010/0005994 A1 * 1/2010 Jacobson ..... F42D 1/05 102/215
2012/0111216 A1 * 5/2012 Koekemoer ..... F42C 15/184 102/201
2012/0174809 A1 * 7/2012 Stewart ..... F42C 11/06 102/215
2014/0053750 A1 * 2/2014 Lownds ..... F42C 11/06 102/313
2014/0311370 A1 * 10/2014 Koekemoer ..... F42D 1/055 102/217
2016/0003599 A1 * 1/2016 Hikone ..... F42D 1/045 102/301
2016/0195379 A1 * 7/2016 Van Wyk ..... F42D 1/05 102/215
2016/0223310 A1 * 8/2016 Morris ..... F42C 13/06

FOREIGN PATENT DOCUMENTS

WO WO-0159401 A1 * 8/2001 ..... F42D 1/05
WO 2006047823 5/2006
WO 2011044593 4/2011

* cited by examiner

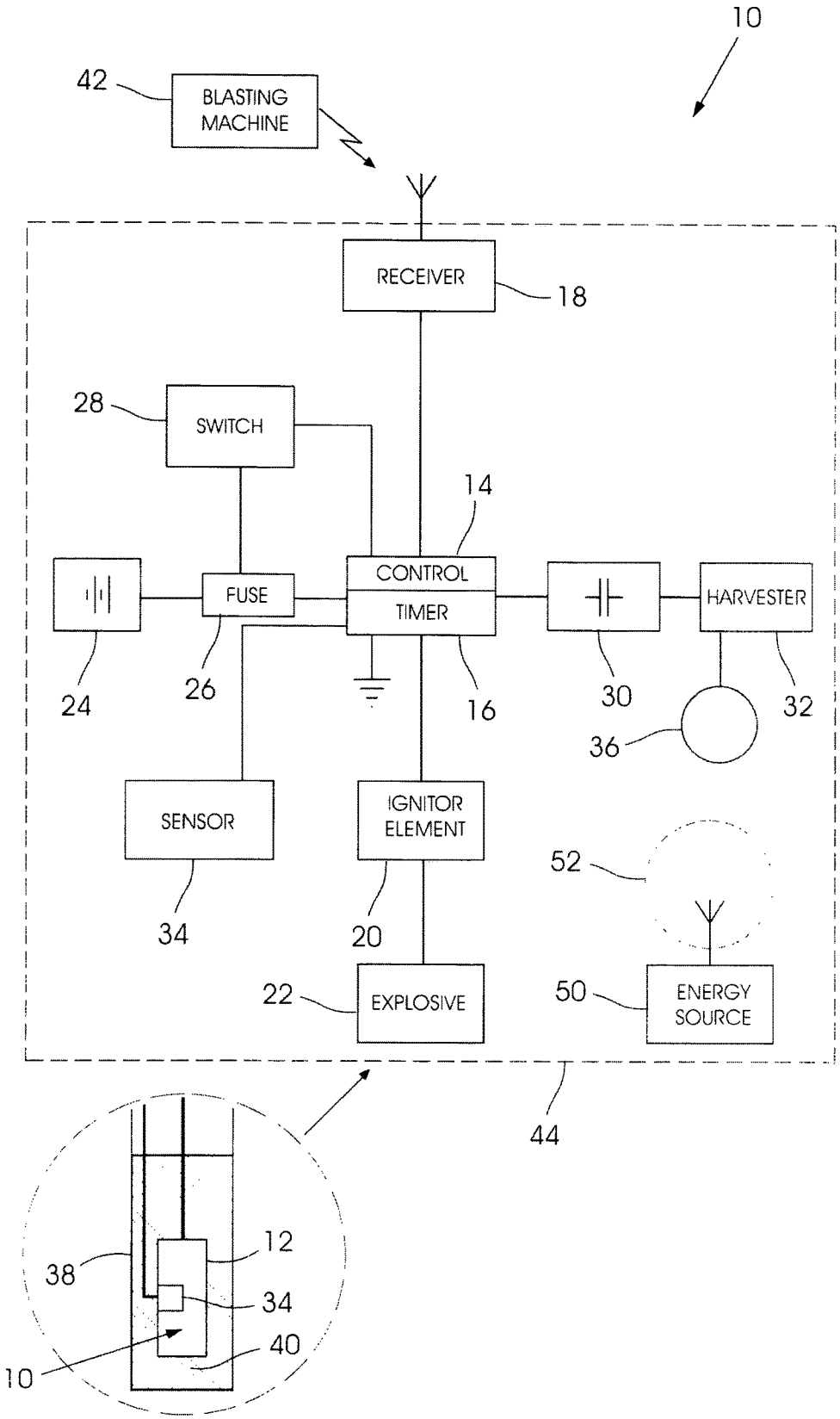
10
42
BLASTING MACHINE
RECEIVER
18
28
SWITCH
14
CONTROL
TIMER
FUSE
HARVESTER
24
26
16
30
32
36
SENSOR
IGNITOR ELEMENT
52
34
20
22
EXPLOSIVE
50
ENERGY SOURCE
44
38
12
34
40
10

WIRELESS DETONATOR

The present application is a U.S. National Phase application of PCT/ZA2016/050028 filed Aug. 4, 2016, which claims priority to Application No. ZA 2015/08238, filed Nov. 9, 2015, the entire contents of both of which are herein incorporated by reference.

BACKGROUND OF THE INVENTION

This invention relates to a wireless detonator.

In order for a wireless detonator to be used safely and effectively it must be activated (switched on), immediately before deployment. As a wireless detonator has an on-board energy source, typically a battery, a situation in which battery life can be exceeded before firing of the detonator takes place must be avoided.

In one solution to this problem a detonator has been equipped with a magnetic reed switch which is enabled, using a suitable magnet, at the time the detonator is placed into a blast hole. This approach is, however, not completely satisfactory because a reed switch can be actuated erroneously by a stray magnetic field such as that generated, for example, by a current-carrying conductor.

In a different approach an optical signal is used to enable the battery. This can present technical problems. Another technique requires the battery to be loaded into the detonator immediately before deployment. This can be difficult for account must be taken of the arduous conditions which can prevail in a mining environment.

Apart from these aspects, a wireless detonator is sensitive to power consumption. Communication with the detonator consumes energy which is drawn from the on-board battery source. Communication is slow through rock (when the detonator is installed in a borehole) and a short message can take a long time to be transmitted, during which period energy can continuously be drawn from the battery. At all times care must be taken to ensure that there is adequate energy in the battery to fire an ignition element when required.

An object of the present invention is to address, at least to some extent, the aforementioned factors.

SUMMARY OF THE INVENTION

The invention provides a wireless detonator which includes a control unit, an ignition element, an energy source which is configured to fire the ignition element in response to a signal from the control unit, a communication module, and an energy harvesting unit which harvests energy from an external electromagnetic field which is used to power, at least, the communication module.

The harvested energy may also be used to power, at least in part, the control unit.

The detonator may include a sensor which inhibits firing of the ignition element by the energy source and which only allows firing of the ignition element by the energy source if the sensor is placed in proximity to a bulk explosive. The sensor may for example be responsive to the presence or absence of an emulsion explosive. By way of example the sensor may be responsive to the presence of the molecule $NH_4$. The same or a second sensor may be responsive to the presence of the molecule $NO_3$. Other sensors can be designed which are responsive to particular molecules carried in an explosive which is employed in a blast hole.

According to another aspect of the invention the detonator includes a fuse connected in a current path between the energy source and the ignition element and a switch which is operable in response to a signal from the control unit to discharge the energy source and to open-circuit the fuse. This signal may be generated by the control unit at a predetermined time, for example, if the firing of the ignition element has not occurred despite reception of a fire command by the communication module.

BRIEF DESCRIPTION OF THE DRAWING

The invention is further described by way of example with reference to the accompanying drawing which is a block diagram of components included in a detonator according to the invention.

DESCRIPTION OF PREFERRED EMBODIMENT

The accompanying drawing illustrates components of a detonator 10 according to the invention. The various components are mounted in a detonator can 12 (see insert drawing) according to requirement. The detonator 10 is one of a plurality of similar detonators (not shown) included in a blasting system at a blasting site.

The detonator 10 includes a control unit 14 which embodies a timer 16, a communication module 18, an ignition element 20, e.g. a bridge, a fuse or a hot-spot, a primary explosive 22, an on-board energy source in the form of a battery 24, a fuse 26 which is connected in a current path between the energy source 24 and the ignition element 20, a switch 28, an energy storage device 30 which, typically, is a battery or a capacitor, and an energy harvesting unit 32. Optionally the detonator 10 includes at least one sensor 34.

The control unit 14 is an application specific integrated circuit designed for the purpose. The communication module 18 normally includes a receiver and under certain conditions may also include a radio transmitter. The switch 28 is a semi-conductor switch which is operable in response to a signal from the control unit 14. The fuse 26 is a so-called poly-fuse mounted to a printed circuit board (not shown) which also carries the various components shown in the drawing.

The energy harvesting unit 32 comprises a plurality of conductive windings 36, i.e. coils, which extend over a maximum area as may be available inside the detonator can 12 which is made from a suitable material, or which is otherwise configured, so that electromagnetic energy (waves) can impinge on the windings without being attenuated by the can.

The explosive sensor 34 is responsive to at least one molecule embodied in a bulk explosive, e.g. an emulsion, which in use is placed into a borehole 38. The molecule may be $NH_4$ or $NO_3$ (for example) The detonator in use is positioned in the bulk explosive 40 and is used to fire the bulk explosive. As appropriate additional sensors, responsive to other molecules or external parameters, may be employed to provide control signals to the control unit 14.

The insert drawing diagrammatically illustrates a detonator can 12 immersed in a bulk explosive 40 which is placed in a borehole 38 at the blast site. The sensor 34 is positioned so that it is exposed to the bulk explosive 40 and can detect the presence of a target molecule.

At the blasting site a controller, e.g. a blasting machine 42 is employed to communicate with the detonators which are included in the blasting system. Each detonator 10 is placed into a respective blast hole.

Timing commands can be transmitted by the blasting machine 42 to the detonators. Also, the integrity of each detonator can be assessed provided that each detonator, in response to an interrogating signal from the blasting machine 40, is capable of transmitting a return signal to the blasting machine 42. This can be done in different ways which are known in the art.

Communications from the blasting machine 42 to the detonator 10 require the establishment of a high amplitude electromagnetic field. Communication signals are impressed (modulated) on the electromagnetic field. For example the blasting site can be surrounded by wire coils 44 which carry a suitable energising signal generated by the blasting machine 42. The energy harvesting unit 32 is designed to extract energy from the electromagnetic field and to store the harvested energy in the energy storage device 26. The unit 32 includes the plurality of coils 36 which, when exposed to the electromagnetic field, have a flow of current induced into them. The induced current is processed in the harvester 32 to produce an energy output at a suitable voltage which is used to charge the device 30. This stored energy is used to power the control unit 14. Use is not made of the energy in the battery 24 to power the control unit.

The energy harvesting process can be repeated as required, for each time the electromagnetic field is established, energy is harvested, stored and used to power the detonator 10 in all respects, as may be required, except for when the detonator 10 is to be fired.

A firing signal which is received by the receiver 18 is transmitted to the control unit 14 and identified. At this point the control unit 14 is operable to connect the battery 24 to the ignition element 20 and, after expiry of a time delay associated with the detonator and measured by the timer 16, the energy in the battery 24 is used to ignite the ignition element 20 and thereby to fire the primary explosive 22.

The detonator 10 thus makes use of two energy sources, namely the on-board energy source or battery 24 which is used for detonator firing purposes, and the components 30, 32 and 36 which are used for communication functions. The energy in the battery 24 is thus preserved during communications. The possibility therefore exists of decreasing the size and capacity of the battery 24 or of making use of an organic printed battery in the detonator 10.

As an alternative to harvesting energy from an external electromagnetic field established by the blasting machine 42, or in addition thereto, a custom designed tagger 50 can be employed. The tagger 50 is a hand-held mobile device which generates a localised magnetic field 52 to which the detonator 10 is exposed immediately before the detonator 10 is inserted into a blast hole 38. Energy is then harvested and transferred to the storage device 30. This allows the functions of the detonator to be tested and evaluated without using energy drawn from the battery 24.

In order to fire the ignition element 20 the battery 24 must be connected to the ignition element. To enhance the safety of the detonator the sensor 34, which is responsive to being placed in proximity to a bulk explosive 40, will only allow the control unit 14 to connect the battery 24 to the ignition element 20 if the sensor 34 detects the presence of the bulk explosive. Under these conditions the connection between the battery 24 and the ignition element 20 takes place when a timing interval, initiated upon reception of a valid firing signal by the communication module 18, has been executed by the timer 16.

Although the control unit 14 is destroyed when a blast takes place it could continue to function if a misfire occurs. The control unit 14 might then still be capable of detecting if the ignition element 20 had not been fired despite the reception of a valid firing signal. Inadvertent firing of the ignition element could however still take place with energy being drawn from the battery 24. If this unsafe condition is detected by the control unit 14, a signal is sent from the control unit 14 to the semi-conductor switch 28 and the battery 24 is connected to earth through the fuse 26. The battery 24 is thereby at least partly discharged and, at the same time, the fuse 26 is open-circuited. This two-prong approach guards against inadvertent firing of the detonator.

The invention claimed is:

1. A wireless detonator which includes a control unit, an ignition element, an energy source which is configured to fire the ignition element in response to a signal from the control unit, a communication module, an energy harvesting unit which harvests energy from an external electromagnetic field which is used to power, at least, the communication module, a sensor which inhibits firing of the ignition element by the energy source and which only allows firing of the ignition element by the energy source if the sensor detects that the sensor is in proximity to a bulk explosive, wherein the harvested energy is also used to power, at least in part, the control unit.

2. A wireless detonator according to claim 1 wherein the sensor is responsive to the presence of the molecule NH4 or the presence of the molecule NO3.

3. A wireless detonator which includes a control unit, an ignition element, an energy source which is configured to fire the ignition element in response to a signal from the control unit, a communication module, an energy harvesting unit which harvests energy from an external electromagnetic field which is used to power, at least, the communication module, a fuse connected in a current path between the energy source and the ignition element and a switch which is operable in response to a signal from the control unit to discharge the energy source at least partly and to open-circuit the fuse.

4. A wireless detonator according to claim 3 wherein the signal is generated by the control unit if the firing of the ignition element has not occurred despite reception of a fire command by the communication module.

5. A wireless detonator which includes a control unit, an ignition element, an energy source which is configured to fire the ignition element in response to a signal from the control unit, a communication module, an energy harvesting unit which harvests energy from an external electromagnetic field which is used to power, at least, the communication module, a sensor which inhibits firing of the ignition element by the energy source and which only allows firing of the ignition element by the energy source if the sensor detects that the sensor is in proximity to a bulk explosive.

6. A wireless detonator according to claim 5 wherein the sensor is responsive to the presence of the molecule NH4 or the presence of the molecule NO3.

* * * * *